US005520164A

United States Patent [19]

Huddleston

[11] Patent Number: 5,520,164

[45] Date of Patent: May 28, 1996

[54] QUICK CONNECT/DISCONNECT ADAPTER FOR ARCHERY RELATED ACCESSORIES

[76] Inventor: Jerry R. Huddleston, 1685 Victor Ave., Ypsilanti, Mich. 48197

[21] Appl. No.: 243,684

[22] Filed: May 16, 1994

[51] Int. Cl.[6] ..... F41B 5/00; F41B 5/20

[52] U.S. Cl. ..... 124/86; 124/89

[58] Field of Search ..... 124/23.1, 24.1, 124/25.6, 44.5, 86, 88, 89; 403/348, 349; 285/361, 396, 402

[56] References Cited

U.S. PATENT DOCUMENTS

| | | | |
|---|---|---|---|
| 1,171,380 | 2/1916 | Arthur | 403/349 X |
| 2,601,088 | 6/1952 | Burgess | 403/349 X |
| 2,793,902 | 5/1957 | Govan | 403/349 X |
| 2,820,655 | 1/1958 | Hileman | 403/349 |
| 3,412,725 | 11/1968 | Hoyt | 124/89 X |
| 3,423,781 | 1/1969 | Henson | 403/349 X |
| 3,524,441 | 8/1970 | Jeffery | 124/89 |
| 4,518,162 | 5/1985 | Oates . | |
| 4,661,009 | 4/1987 | Tripp | 403/349 |
| 5,038,510 | 8/1991 | Duke | 124/86 X |
| 5,052,849 | 10/1991 | Zwart | 403/349 X |
| 5,094,464 | 3/1992 | Musacchia | 403/349 X |
| 5,178,122 | 1/1993 | Simonds | 124/25.6 |
| 5,388,563 | 2/1995 | Hsu | 124/23.1 |

FOREIGN PATENT DOCUMENTS

| | | | |
|---|---|---|---|
| 1429924 | 3/1976 | United Kingdom | 403/349 |

OTHER PUBLICATIONS

Muzzy Inc. Advertisement for "SPEEDLOC".

*Primary Examiner*—Eric K. Nicholson
*Assistant Examiner*—John A. Ricci
*Attorney, Agent, or Firm*—Gifford, Krass, Groh, Sprinkle, Patmore, Anderson & Citkowski

[57] ABSTRACT

A universal adapter unit allows an archery-related accessory to readily and quickly connect and disconnect from a bow providing an attachment point for such accessories. The adapter includes two components, a first component intended for semi-permanent attachment to the bow at the attachment point, and a second component intended for semi-permanent attachment to an archery related accessory. A quick connect/disconnect type of connection system is provided between the two components, so that an accessory fitted with a second component may quickly and easily attach to a bow including the first component. Since, typically, the bow connection point is a threaded receptacle, the use of the first ad second components of the invention markedly speeds the attachment and detachment from the bow as compared to the use of the standardly provided threaded connection point. Moreover, since the invention is universally applicable to any type of accessory, it is expected that a typical user will provide each of a plurality of accessories with one of the second components, so that one may quickly be removed and another quickly coupled to the bow.

5 Claims, 1 Drawing Sheet

QUICK CONNECT/DISCONNECT ADAPTER FOR ARCHERY RELATED ACCESSORIES

FIELD OF THE INVENTION

The present invention relates generally to archery and, in particular, to an adapter unit which provides a quick connect/disconnect function to archery-related accessories.

BACKGROUND OF THE INVENTION

The sport of archery is very popular, and is enjoyed by numerous enthusiasts. To meet the demands of these individuals, archery-related equipment is advancing rapidly in terms of technological sophistication. For example, the compound bow, which facilitates steady aiming with a powerful release, has steadily grown in popularity, and is now common among more advanced users. A wide variety of archery-related accessories have also been introduced to make the sport more precise, yet comfortable, and to appeal to even wider audiences.

To accommodate bow-attachable accessories, modern bows are provided with a connection point for such purposes, typically in the form of a threaded receptacle or socket located on the front of the bow facing the target. Numerous accessories are commercially available for engagement at this accessory point, including counterweights, fishing devices, and sighting units.

Although a wide variety of such bow-attachable accessory devices are available, they are cumbersome to attach and detach, owing to the time required to manipulate this threaded connection point. For example, by the time one type of sight or counterweight is removed to install another, the intended target may have left the scene. Manipulation of threaded connectors is particularly difficult with respect night hunting since these sportspeople may wish to remain as quiet and unobtrusive as possible.

The prior art does contain one form of quick connect/disconnect accessory for archery-related equipment, this being the securable removable fishing pole described in U.S. Pat. No. 5,038,510. Although the system described therein may be of benefit to those interested in fishing, the teachings to do address a more universal style of adapter unit applicable to any type of accessory designed for attachment to the bow, typically via this threaded connection point. A more universal adapter is particularly desirable in states which require hunting bows to be enclosed during transport, requiring users to frequently connect and disconnect more commonly employed accessories such as stabilizers, since the bow will not fit its case with such attachments engaged. Often this must be done at night, further complicating matters.

SUMMARY OF THE INVENTION

The present invention provides an adapter unit which allows an archery-related accessory to readily and quickly connect and disconnect from a bow providing an attachment point for such accessories. Broadly, the adapter unit includes two components: a first component intended for semi-permanent attachment to the bow at the attachment point, and a second component intended for semi-permanent attachment to an archery related accessory. A quick connect/disconnect type of connection system is provided between the two components, so that an accessory fitted with a second component may quickly and easily attach to a bow including the first component. Since, typically the bow connection point is a threaded receptacle, the use of the first ad second components of the invention markedly speeds the attachment and detachment form the bow as compared to the use of the standardly provided threaded connection point. Since the invention is universally applicable to any type of accessory, it is expected that a typical user will provide each or a plurality of accessories with one of the second components, so that one may quickly be removed and another quickly coupled to the bow.

Preferably, the first component includes a first end adapted to be removably secured to the bow at the attachment point, and a second end including a first portion of the quick connect/disconnect connection system. The second component includes a first end removably securable to an archery-related accessory, and a second end including the remaining portion of the quick connect/disconnect connection system. Given a bow with a threaded connection point, the first component includes a threaded projection adapted for engagement with the bow, and the second component includes a threaded receptacle adapted for engagement with the threaded projection of the archery-related accessory. Modernly such threads are 5/16"×24, through the invention is equally applicable to any type of bow connector, including variations in thread dimensions.

In the preferred embodiment, the quick connect/disconnect connector is of the type which results in a substantially rigid connection when engaged. Various well-known connection styles are applicable, including twisting versions and push-pull types. To aid with rigidity, the first component may include a rod which projects from the front of the bow when the component is installed and a bore on the second component to receive the rod. The rod may include a compressible material such as one or more o-rings to further assist with rigidity. The outer surface of the second component may be textured to enhance gripping to ease attachment/detachment.

DETAILED DESCRIPTION OF THE PREFERRED EMBODIMENT

Figure 1:
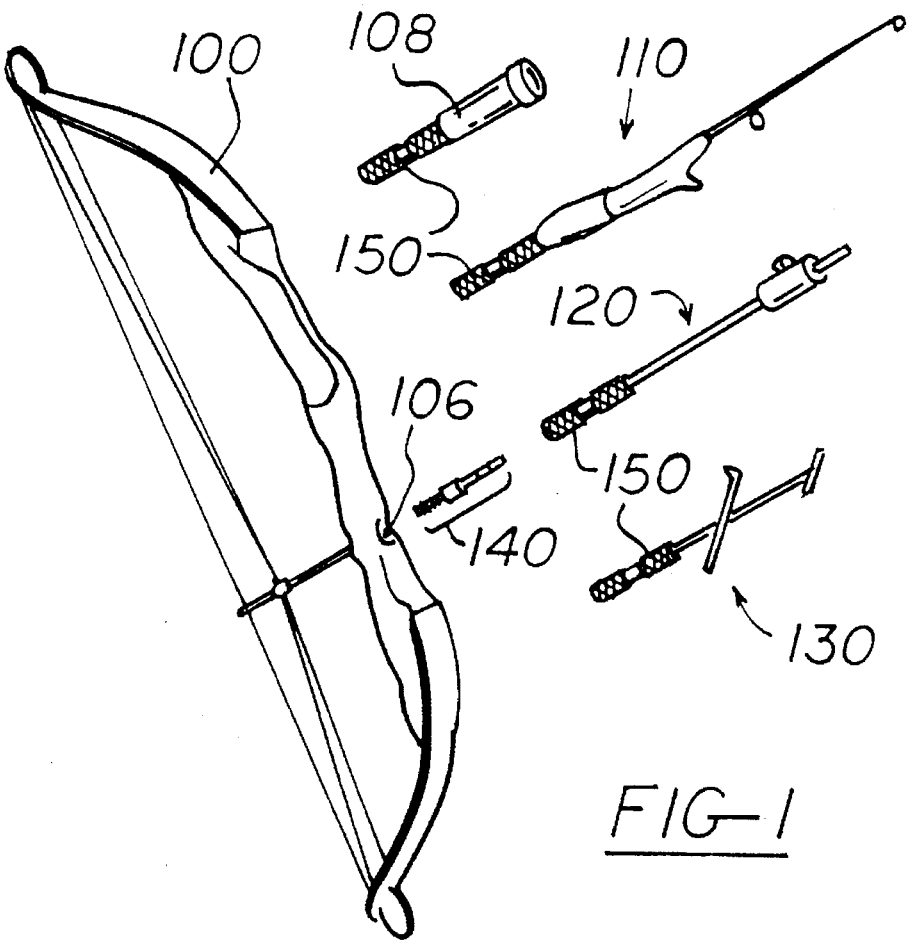
FIG. 1 is an oblique drawing of a bow and archery-related accessories which a user may wish to attach thereto.

The present invention provides such a universal adapter unit for archery-related accessories. The invention includes two components, one which attaches at the accessory connection point and is intended to remain secured to the bow in a semi-permanent fashion. The other component is designed for attachment to an archery-related accessory, and is intended to remain secured to that accessory in a semi-permanent fashion as well. Between the two components, the invention provides a quick-connect/disconnect type of connection mechanism characterized in being substantially rigid when engaged, thereby enabling accessories equipped with the second component to be quickly yet rigidly secured to the bow and removed in an equally fast and straightforward fashion. FIG. 1 is an oblique drawing which provides a pictorial overview of the invention. A bow 100 is provided with a standard connection point at 106, typically in the form of a threaded receptacle. The characteristics of this threading are now typically 5/16" diameter with 24 threads per inch. Although FIG. 1 shows a compound type of bow 100 having a threaded receptacle 106, the invention is useful with any type of bow in combination with any type of standardly provided attachment mechanism.

FIG. 1 further shows three accessories which a user of bow 100 wishes to attach to the bow at point 106 in accordance with a particular use of the bow. For example, the user may wish to install a flashlight 108, a fishing rod 110, fishing reel (not shown), a stabilization device 120, or a sighting mechanism 130, though use of the present invention is by no means restricted to the application of these particular accessories. An identical component of the present invention 150 is preferably secured to each accessory which the user would like to provide with a quick connect/release capability. In the event that the bow and accessories are joined using a standard threaded type of connector, the component 150 includes a threaded receptacle at one of its ends identical to that supplied at point 106 of the bow, thus enabling each accessory to be secured thereto.

The other component of the present invention is member 140 which, again in the case of a threaded receptacle 106, provides at one end a threaded shaft which may be screwed into the receptacle 106, thus forming a semi-permanent connection between the element 140 and bow 100. The invention further provides a quick connect/disconnect type of connection mechanism between the element 140 and each element 150 semi-permanently attached to each archery-related accessory. The specific characteristics of this connection system provided by the present invention are further described with reference to FIG. 2.

Figure 2:
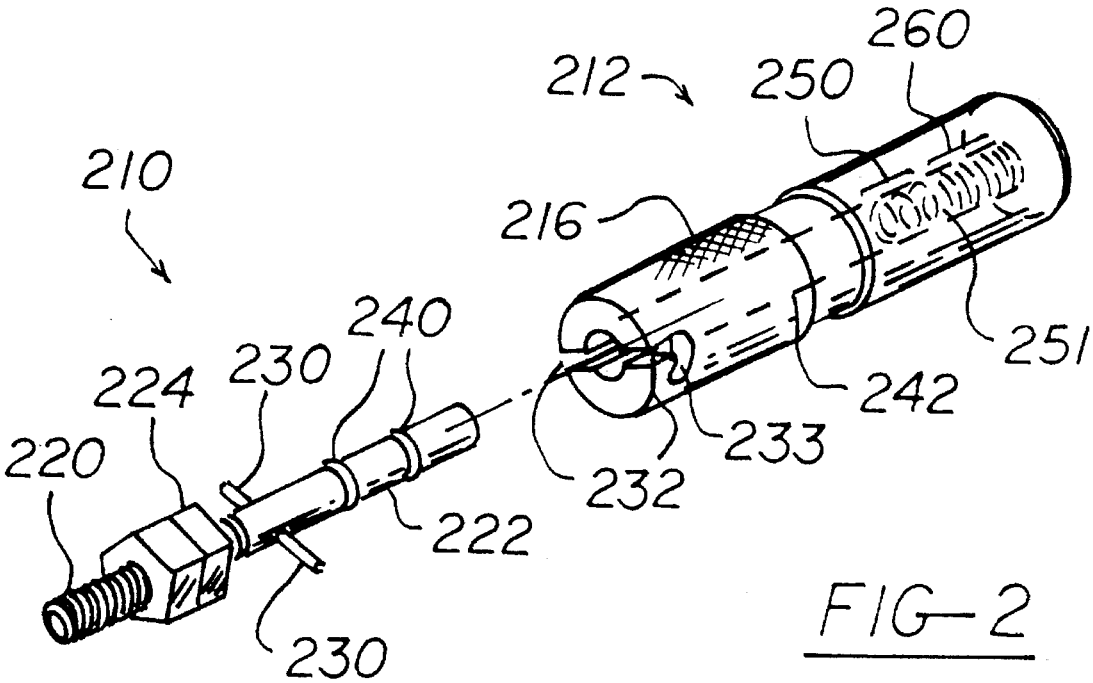
FIG. 2 is an oblique drawing of two components forming a quick connect/disconnect adapter for archery related accessories.

Although FIG. 2 represents a preferred embodiment of a quick connect/disconnect connection system provided by the present invention, this is by no means the only type of connection system which may be used. Various other known and custom quick connect/release mechanisms may also be used. For example, while the embodiment of FIG. 2 illustrates a connection system which locks and unlocks by virtue of rotation about an axial path, connection systems which secure through pushing and release through pulling may also be utilized.

In FIG. 2, the component shown at 210 is intended for semi-permanent attachment to the bow, whereas the component shown generally at 212 is that intended for semi-permanent attachment to each accessory which the user desires to impart a quick/disconnect function. The component 210 preferably includes at one end means for attachment to the bow, the embodiment shown being threaded end 220 adapted for a screw-in connection with a threaded bow receptacle such as that shown at point 106 on bow 100 in FIG. 1. A nut may be added to threaded end 220 which may be useful for urging against the front surface of the bow itself once end 220 has been inserted thereinto, so as to provide locking retainment. Alternatively, two locking nuts 224 as shown may be used for tightening of component 210, or a flattened surface or slot may be provided on component 210 for such tightening.

The non-threaded end of element 210 is preferably elongated or shaft-like in construction, so as to provide a more stable and rigid marriage with component 212, which preferably includes a bore to receive rod 222. However, this rod/bore combination is not necessary to the present invention, in the event that the quick connect/disconnect system is sufficiently rigid and stable once joined. In other words, if the quick/disconnect attachment is inherently rigid for other reasons, the rod/bore combination just described may be unnecessary. If rod 222 is used, however, it may preferably include compressible material, for example O-rings 240 retained in grooves formed around the outer area of rod 222. This compressible material, being optional, may consume more or less of the surface of rod 222 shown in the drawing, or be eliminated all together in the event that the connection system is sufficiently rigid without such material 240, as mentioned previously.

The actual quick connect/disconnect mechanism depicted in FIG. 2 makes use of two outwardly projecting lugs 230 which, when rod 222 is properly inserted into bore 242 in component 212, engage with slots 232 and, with a pushing and twisting motion at least some of the distal portions of projections 232 rest in recesses 233. Connection systems of this type may be termed "bayonet" connectors. The projections 230 are preferably retained within these recesses by the action of spring 250 preferably located at the bottomost section of the bore 242. A wall 251 may be included or formed within the bore 242 as a means of retaining the end of the spring away from component 210. Although the coupling between components 210 and 212 is carried out with a clockwise twist and removed with a counterclockwise twist, obviously this order may be reversed. Threads 260 within component 212 are used to receive the threaded shaft found on each archery-related accessory with which the invention is intended to be used. To further assist in the attachment and detachment of the component 212 to and from the component 210, component 212 may have a machined or textured outer surface, preferably formed through a machining process such as the knurling, depicted at 216, which may cover a portion or all of the outer surface of component 212.

Having thus described my invention, I claim:

1. An archery system, comprising:

a bow having a threaded receptacle to accept an archery-related accessory;

one or more of the archery-related accessories, each with a threaded post adapted to mate with the threaded receptacle of the bow; and an adapter unit, comprising:

a first component including a first, threaded end adapted to be removably secured to the bow within the threaded receptacle, and a second end including a first portion of a quick connect/disconnect connector; and a second component including a first end with a threaded receptacle into which the threaded post of one of the archery-related accessories may be removably secured, and a second end including the remaining portion of the quick connect/disconnect connector, the quick connect/disconnect connector being of the type which results in a substantially rigid connection when engaged, whereby the first component may be semi-permanently attached to the bow, and the second component may be semi-permanently attached to one of the archery-related accessories, thereby enabling the accessory to be quickly yet rigidly removably secured to the bow through the use of the quick connect/disconnect connector.

2. The adapter unit of claim 1 wherein all the threads are $5/16''\times 24$.

3. The adapter unit of claim 1 wherein the quick connect/disconnect connector comprises:

a groove formed around the first component at a point along its length; and a force-loaded element associated with the second component which engages with at least a portion of the groove when the quick connect/disconnect connector is engaged.

4. The adapter unit of claim 1, the quick connect/disconnect connector being of the bayonet type.

5. The adapter unit of claim 4 wherein the quick connect/disconnect connector comprises:

a rod extending perpendicularly through the first component at a point along its length; and the second component includes channels adapted for mating engagement with the rod projections, the connect/disconnect connector using twisting motion in one direction to facilitate locking attachment and twisting motion in the opposite direction for detachment.

* * * * *